US006715538B2

(12) United States Patent
Horttanainen et al.

(10) Patent No.: US 6,715,538 B2
(45) Date of Patent: Apr. 6, 2004

(54) SUPPLY AIR TERMINAL DEVICE

(75) Inventors: Pekka Horttanainen, Lahti (FI); Marko Häkkinen, Kuusankoski (FI); Mika Ruponen, Lahti (FI); Reijo Villikka, Kausala (FI); Maija Virta, Hamina (FI)

(73) Assignee: Halton Oy, Kausala (FI)

( * ) Notice: Subject to any disclaimer, the term of this patent is extended or adjusted under 35 U.S.C. 154(b) by 0 days.

(21) Appl. No.: 09/994,171

(22) Filed: Nov. 26, 2001

(65) Prior Publication Data

US 2002/0056545 A1 May 16, 2002

(30) Foreign Application Priority Data

Nov. 24, 2000 (FI) ..... 20002590

(51) Int. Cl.[7] ..... F28F 27/00; F01P 7/10; F24F 13/14

(52) U.S. Cl. ..... 165/96; 165/99; 454/266

(58) Field of Search ..... 165/123, 122, 165/96, 98, 99, DIG. 18; 454/262, 263, 266, 160

(56) References Cited

U.S. PATENT DOCUMENTS

| | | | | |
|---|---|---|---|---|
| 2,937,588 A | | 5/1960 | Masin et al. | 98/38 |
| 3,041,047 A | | 9/1962 | Ashley et al. | 257/297 |
| 3,186,327 A | | 6/1965 | Giurlando et al. | 98/38 |
| 3,223,149 A | * | 12/1965 | Miner | 454/262 |
| 3,650,318 A | * | 3/1972 | Avery | 165/215 |
| 3,669,349 A | | 6/1972 | Hall, Jr. | 236/13 |
| 3,752,226 A | | 8/1973 | Bullock | 165/59 |
| 3,823,870 A | * | 7/1974 | Chandler | 454/264 |
| 3,833,057 A | * | 9/1974 | Doherty | 165/123 |
| 3,877,513 A | * | 4/1975 | Arledge, Jr. | 165/123 |
| 3,883,071 A | * | 5/1975 | Meckler | 454/264 |
| 3,937,132 A | | 2/1976 | Bruhlmeier et al. | 98/40 |
| 3,981,326 A | | 9/1976 | Gorchev | 137/604 |
| 4,148,435 A | | 4/1979 | Meyers et al. | 236/13 |
| 4,448,111 A | | 5/1984 | Doherty | 98/38 |
| 4,616,559 A | | 10/1986 | Barlow | 98/40.11 |
| 5,180,331 A | | 1/1993 | Daw et al. | 454/187 |
| 5,216,998 A | | 6/1993 | Hosoda et al. | 137/625.28 |
| 5,218,998 A | | 6/1993 | Bakken et al. | 137/625.28 |
| 5,427,146 A | | 6/1995 | Bakken et al. | 137/625.3 |
| 6,128,832 A | * | 10/2000 | Stueble | 34/448 |
| 6,213,867 B1 | * | 4/2001 | Yazici et al. | 454/263 |

FOREIGN PATENT DOCUMENTS

| | | |
|---|---|---|
| AU | 6761681 | 9/1981 |
| CA | 988359 | 5/1976 |
| DE | 1778188 | 11/1971 |
| DE | 2551078 | 5/1977 |
| DE | 2841409 | 4/1980 |
| DE | 3303987 | 8/1984 |

(List continued on next page.)

*Primary Examiner*—Henry Bennett
*Assistant Examiner*—Tho Duong
(74) *Attorney, Agent, or Firm*—Steinberg & Raskin, P.C.

(57) ABSTRACT

The invention concerns a supply air terminal device (10) including a supply chamber (11) for the supply air and in the supply chamber (11) nozzles (12$a_1$, 12$a_2$ . . . ; 12$b_1$, 12$b_2$ . . . ), through which the supply airflow ($L_1$) is conducted into a side chamber ($B_1$) of the supply air terminal device, which side chamber is a structure open at the top part and at the bottom part. The supply air terminal device (10) includes a heat exchanger (14), which can be used either to cool or to heat the circulated airflow ($L_2$). In the device solution, fresh supply air, which is conducted through the nozzles to the side chamber ($B_1$), induces the circulated airflow ($L_2$) to flow through the heat exchanger (14). The combined airflow ($L_1$+$L_2$) of supply airflow ($L_1$) and circulated airflow ($L_2$) is conducted out of the supply air terminal device (10). The supply air terminal device includes an induction ratio control device (15), which is used to control how much circulated airflow ($L_2$) joins the supply airflow ($L_1$).

4 Claims, 6 Drawing Sheets

FOREIGN PATENT DOCUMENTS

| | | | |
|---|---|---|---|
| DE | 3321612 | | 12/1984 |
| DE | 29609754 | U1 | 2/1997 |
| DE | 10007452 | | 8/2000 |
| EP | 0370246 | | 5/1990 |
| EP | 0872694 | | 10/1998 |
| EP | 0924475 | | 6/1999 |
| EP | 0967443 | | 12/1999 |
| EP | 0967444 | | 12/1999 |
| EP | 1122501 | | 8/2001 |
| FI | 58211 | | 8/1980 |
| FI | 990362 | | 2/1999 |
| FR | 1273329 | | 8/1961 |
| FR | 1347152 | | 12/1962 |
| FR | 2807501 | | 12/2001 |
| GB | 1011742 | | 12/1965 |
| GB | 1019077 | | 2/1966 |
| GB | 1555563 | | 11/1979 |
| GB | 1577039 | | 10/1980 |
| GB | 2166863 | | 5/1986 |
| GB | 2244804 | | 12/1991 |
| GB | 2271175 | | 4/1994 |
| GB | 2322934 | | 9/1998 |
| GB | 2349688 | | 11/2000 |
| JP | 3137429 | | 6/1991 |
| WO | 9002297 | | 3/1990 |
| WO | 9809115 | | 3/1998 |
| WO | 0045094 | | 8/2000 |

* cited by examiner

SUPPLY AIR TERMINAL DEVICE

FIELD OF THE INVENTION

The invention concerns a supply air terminal device.

BACKGROUND OF THE INVENTION

Control of the induction ratio has become a requirement in supply air terminal devices, wherein fresh air is supplied by way of the supply air terminal device and wherein room air is circulated using the device. This means that the ratio between the flow of circulated air and the flow of fresh air can be controlled.

OBJECTS AND SUMMARY OF THE INVENTION

In the present application, primary airflow means that flow of supply air, and preferably the flow of fresh supply air, which is supplied into the room or such by way of nozzles in the supply air manifold. Secondary air flow means the circulated air flow, that is, that air flow, which is circulated through a heat exchanger from the room space and which air flow is induced by the primary air flow.

For implementation of the above-mentioned control the present application proposes use of a separate induction ratio control device. According to the invention, the induction ratio control device may be located below the heat exchanger in the mixing chamber. Control may hereby take place by controlling the flow of circulated air $L_2$. The more the air flow $L_2$ is throttled, the lower the induction ratio will be, that is, the air volume made to flow through the heat exchanger becomes smaller in relation to the primary air flow.

Besides the above-mentioned way of controlling the induction ratio, such a control device may also be used, which is formed by a set of nozzles formed by nozzles in two separate rows opening from the supply chamber for fresh air, whereby the nozzles in the first row are formed with a bigger cross-sectional flow area than the nozzles in the second row. The induction ratio control device includes an internal aperture plate used for controlling the flow between the nozzle rows of the said nozzles.

BRIEF DESCRIPTION OF THE DRAWINGS

In the following, the invention will be described by referring to some advantageous embodiments of the invention shown in the figures of the appended drawings, but the intention is not to limit the invention to these embodiments only.

DETAILED DESCRIPTION OF THE INVENTION

Figure 1A:
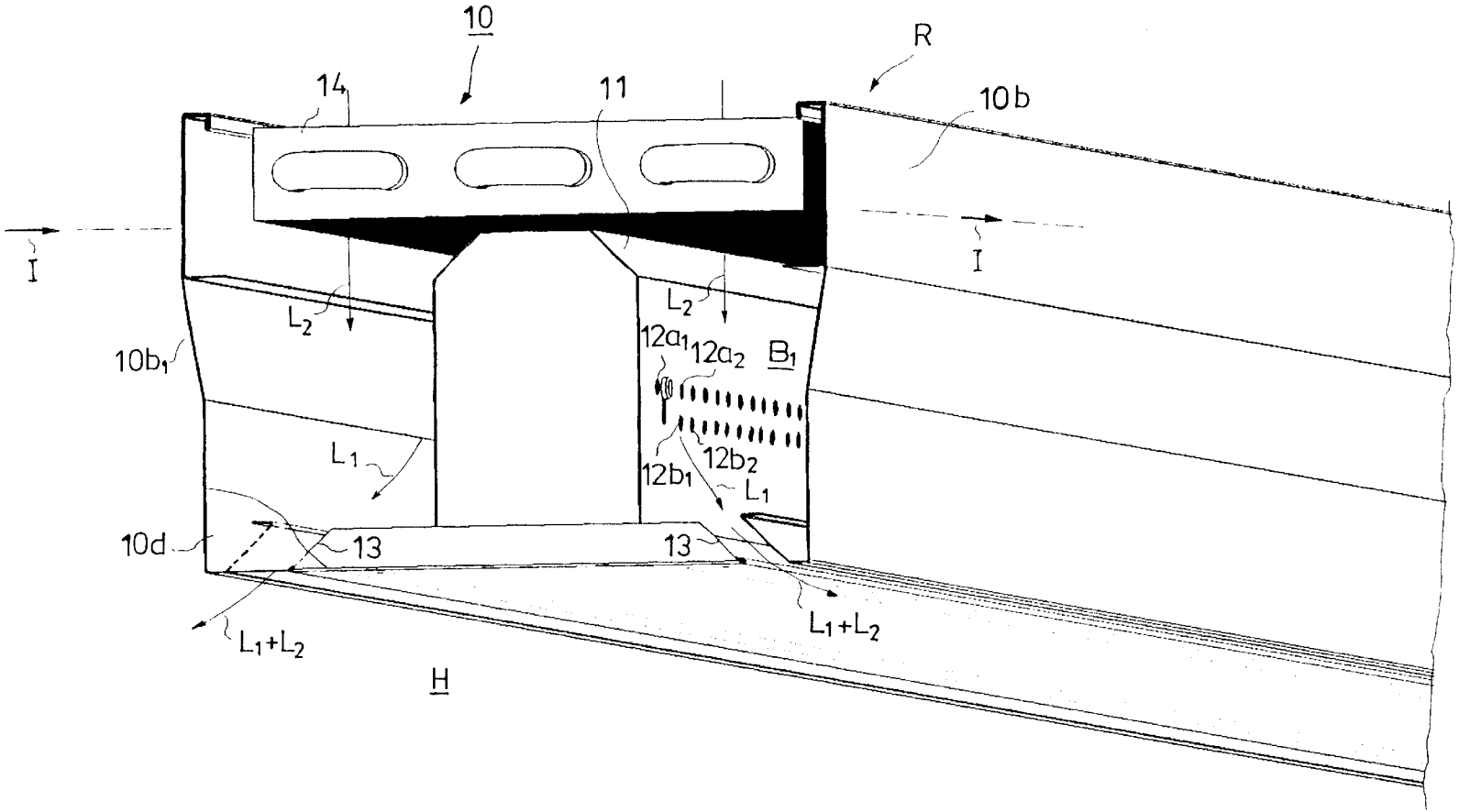
FIG. 1A is an axonometric view of a supply air terminal device according to the invention, which is open at the bottom and open at the top.

FIG. 1A is an axonometric view of the supply air terminal device 10. In order to show the internal parts of the structure, end plate 10*d* is cut open in part. The structure includes end plates 10*d* at both ends. Supply air $L_1$ is conducted by way of a supply channel into supply air chamber 11, from which the air is conducted further through nozzles $\mathbf{12}a_1$, $\mathbf{12}a_2$ . . . , $\mathbf{12}b_1$, $\mathbf{12}b_2$ . . . into side or mixing chambers B, of the device on both sides of the vertical central axis Y, of the device and therein downwards. The supply air terminal device 11 includes a heat exchanger 14 in side chamber B, in its upper part as seen in the figure. Side chambers B, are open at the top and at the bottom. Thus, the flow of circulated air $L_2$ is circulated induced by the primary airflow $L_1$ through heat exchanger 14 into side chamber $B_1$, wherein the airflows $L_1$, $L_2$ are combined, and the combined airflow $L_1$+$L_2$ is made to flow to the side from the device guided by guiding parts $\mathbf{10}b_1$, 13 or such. The secondary airflow $L_2$ is thus brought about by the primary airflow $L_1$ from the nozzles $\mathbf{12}a_1$, $\mathbf{12}a_2$ . . . and $\mathbf{12}b_1$, $\mathbf{12}b_2$ . . . of supply chamber 11. In side chamber $B_1$ the airflows $L_1$, $L_2$ are combined, and the combined airflow is made to flow to the side guided by air guiding parts 13 and the side plates $\mathbf{10}b_1$ of the supply air terminal device, preferably at ceiling level. Heat exchanger 14 may be used for either cooling or heating the circulated air $L_2$. Under these circumstances, the circulated air $L_2$ circulated from room H can be treated according to the requirement at each time either by heating it or by cooling it using heat exchanger 14. Heat exchanger 14 includes tubes for the heat transfer medium and, for example, a lamella heat exchanger structure in order to achieve an efficient transfer of heat from the circulated air to the lamellas and further to the heat transfer liquid, when the flow of circulated airflow $L_2$ is to be cooled, or the other way round, when the flow of circulated airflow $L_2$ is to be heated.

Figure 1C:
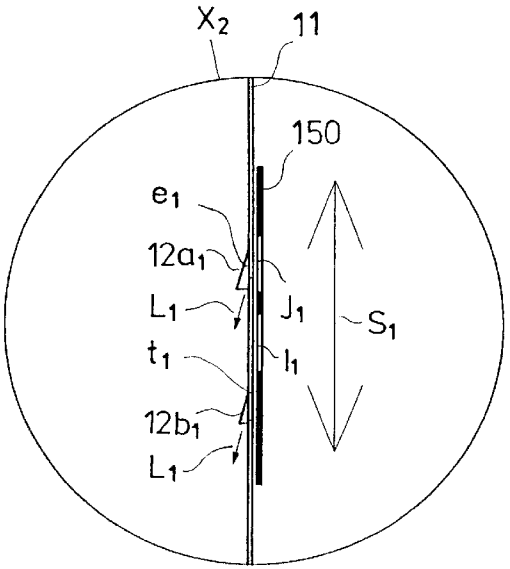
FIG. 1C shows the area $X_2$ of FIG. 1B.
Figure 1B:
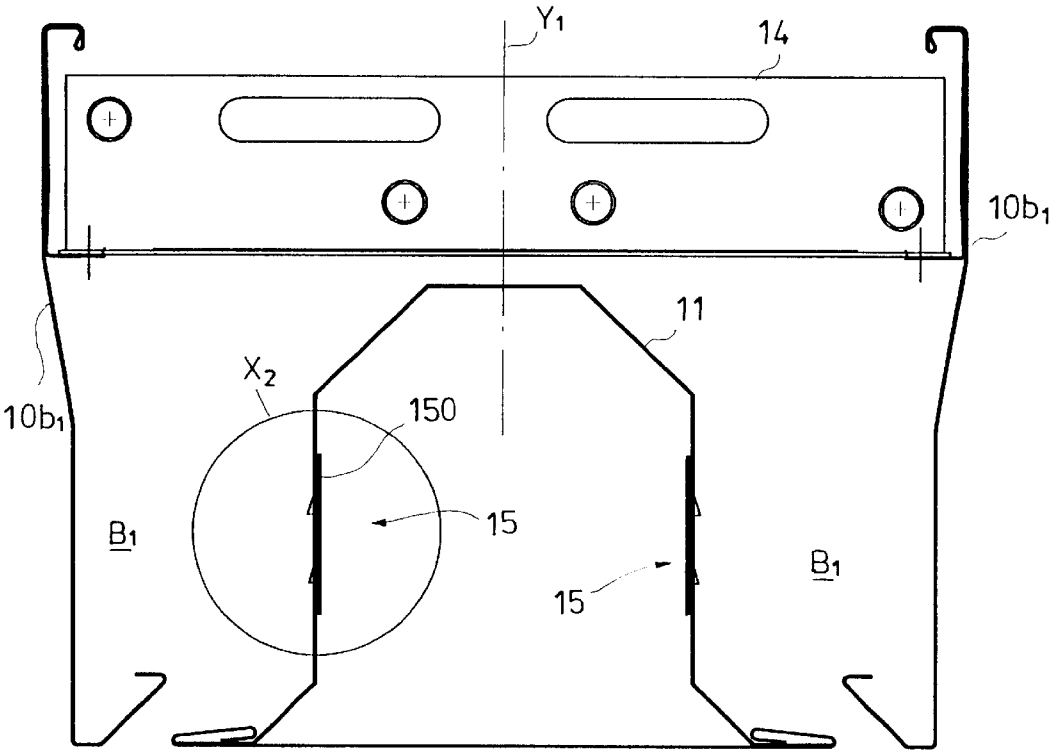
FIG. 1B is a cross-sectional view along line I—I of FIG. 1A.

FIG. 1B is a cross-sectional view along line I—I of FIG. 1A of a first advantageous embodiment of the invention. Supply air terminal device 10 includes a supply air chamber 11 for the fresh supply air, from which the fresh air is conducted as shown by arrows $L_1$ through nozzles $\mathbf{12}a_1$, $\mathbf{12}a_2$ . . . ; $\mathbf{12}b_1$, $\mathbf{12}b_2$ . . . into the respective side or mixing chamber $B_1$ of the device and further into room space H. Supply air chamber 11 is located centrally in the device. Heat exchanger 14 is located in front of supply air chamber 11 (above it in the figure) and side chambers $B_1$ are formed on both sides of the vertical central axis Y, of the device in between side plates $\mathbf{10}b_1$ and the side plates 11*a*, of supply air chamber 11. As the figure shows, side chamber $B_1$ is a structure open both at the top and at the bottom. Circulated air $L_2$ induced by the fresh airflow $L_1$ flows into side chamber $B_1$ from room H, whereby the combined airflow $L_1$+$L_2$ is made to flow further away from the device, preferably to the side horizontally in the direction of the ceiling and further at ceiling level. According to the invention, the body R of the device includes side plates $\mathbf{10}b_1$ and air guiding parts 13 in connection with supply air chamber 11 at its lower edge. Together, the supply air chamber 11 and the side plates 10$b_1$ limit the chamber BI located at the side of the device. The circulated airflow $L_2$ flows through heat exchanger 14 of the device into side chamber $B_1$ induced by the supply airflow $L_1$. Air guiding parts 13 and side plates 10$b_1$ are shaped in such a way that the combined airflow $L_1$+$L_2$ will flow in the horizontal direction to the side and preferably in the ceiling level direction and along this. The heat exchanger 14 may be used for cooling or heating the circulated air $L_2$. In the embodiment shown in the figure, the device includes an induction ratio control device 15, which is used for controlling the flow volume ratio $Q_2/Q_1$ between the flows $L_1$ and $L_2$.

Below the nozzles 12$a_1$, 12$a_2$ . . . of the first row of nozzles the nozzles 12$b_1$, 12$b_2$ . . . of the second row of nozzles and the control plate 150 of the induction ratio control device 15 include flow apertures $J_1$, $J_2$ . . . located above for nozzles 12$a_1$, 12$a_2$ . . . and flow apertures $I_1$, $I_2$ . . . located below for nozzles 12$b_1$, 12$b_2$ . . . When plate 150 is moved in a linear direction vertically (arrow $S_1$), the flow apertures $J_1$, $J_2$ . . . , $I_1$, $I_2$ . . . of plate 150 will be placed in a certain covering position in relation to nozzles 12$a_1$, 12$a_2$ . . . , 12$b_1$, 12$b_2$ . . . and their supply apertures $e_1$, $e_2$ . . . , $t_1$, $t_2$ . . . Thus, the flow $L_1$ can be controlled as desired from nozzles 12$b_1$, 12$b_2$ . . . , 12$a_1$, 12$a_2$ . . . In addition, the supply apertures $e_1$, $e_2$ . . . , $t_1$, $t_2$ . . . of the nozzles 12$b_1$, 12$b_2$ . . . , 12$a_1$, 12$a_2$ . . . are preferably made to be of different size, whereby the flow can be controlled as desired through the nozzles 12$b_1$, 12$b_2$ . . . , 12$a_1$, 12$a_2$ . . . of the nozzle rows having cross-sectional flow areas of different sizes. By increasing the flow $L_1$ through nozzles 12$a_1$, 12$a_2$ . . . of one nozzle row by a corresponding volume the flow through the nozzles 12$b_1$ 12$b_2$ . . . of the other nozzle row is reduced, and vice versa. In this manner the rate of flow $L_1$ can be controlled in side chamber $B_1$ and that induction effect can also be controlled, which flow $L_1$ has on flow $L_2$, that is, the induction ratio between the flows $L_1$ and $L_2$ can be determined. The induction ratio means the relation of flow volume $Q_2$ of flow $L_2$ to the flow volume $Q_1$ of flow $L_1$, that is, $Q_2/Q_1$. The combined airflow $L_1$+$L_2$ flows guided by side guiding parts 13 and 10$b_1$ preferably to the side from the supply air terminal device. With devices according to the invention, the induction ratio is typically in a range of 2–6.

FIG. 1C shows the area $X_2$ of FIG. 1B on an enlarged scale.

Figure 2:
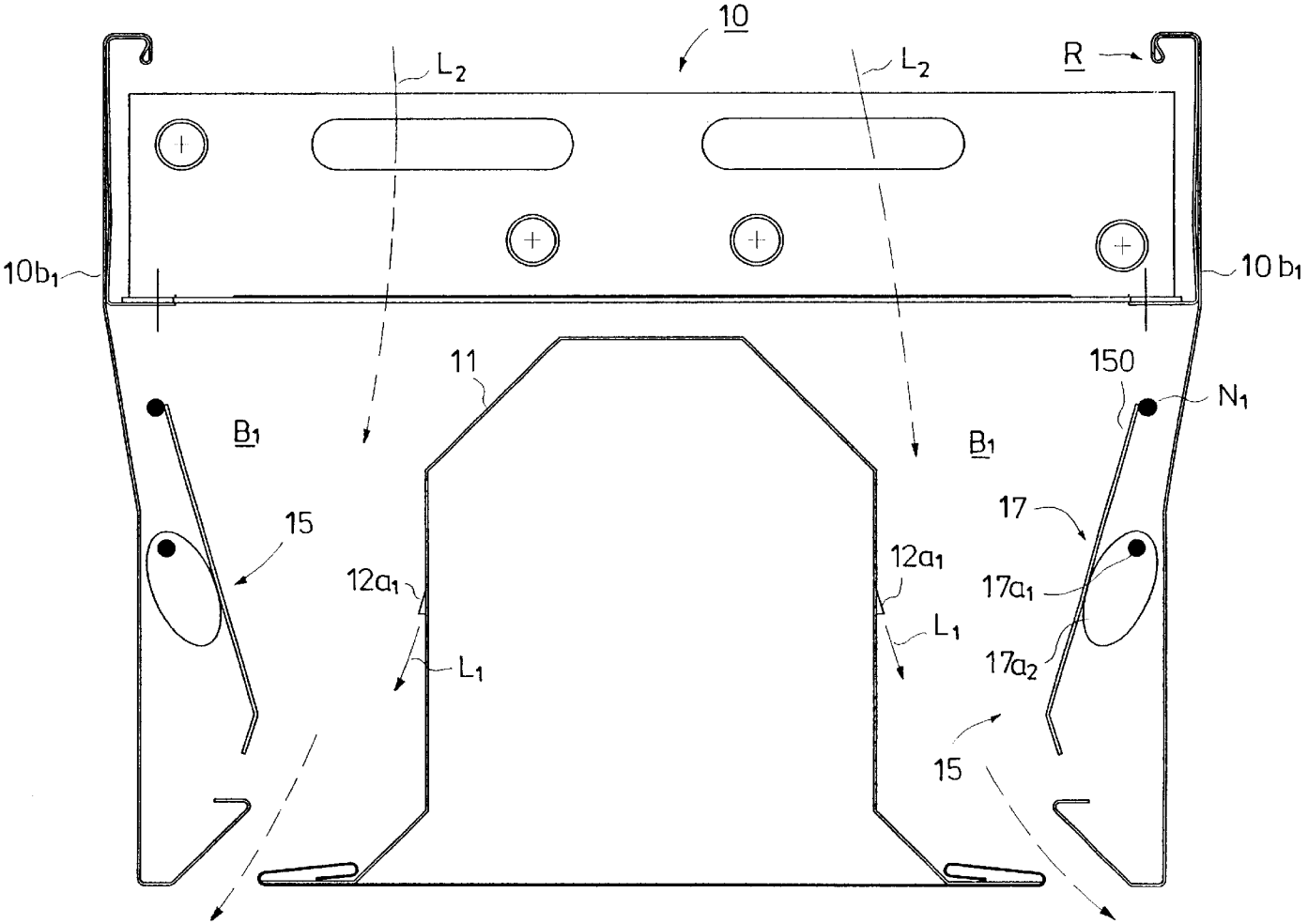
FIG. 2 shows an embodiment of the control device according to the invention, wherein the control device is formed by a turning damper located in side chamber $B_1$.

FIG. 2 shows a second advantageous embodiment of the invention, wherein the induction ratio control device 15 is formed by a control plate 150 turning in side chamber $B_1$. Control plate 150 is articulated to turn around pivot point $N_1$, and control plate 150 is moved by an eccentric piece mechanism 17, which includes a shaft 17$a$, adapted to rotate an eccentric disc 17$a_2$. Eccentric disc 17$a_2$ for its part rotates control plate 150. Thus, in the embodiment shown in FIG. 2, the induction distance of jet $L_1$ is controlled in side chamber $B_1$ and thus the induction ratio $Q_2/Q_1$ between the flows $L_2$ and $L_1$ is controlled.

Figure 3A:
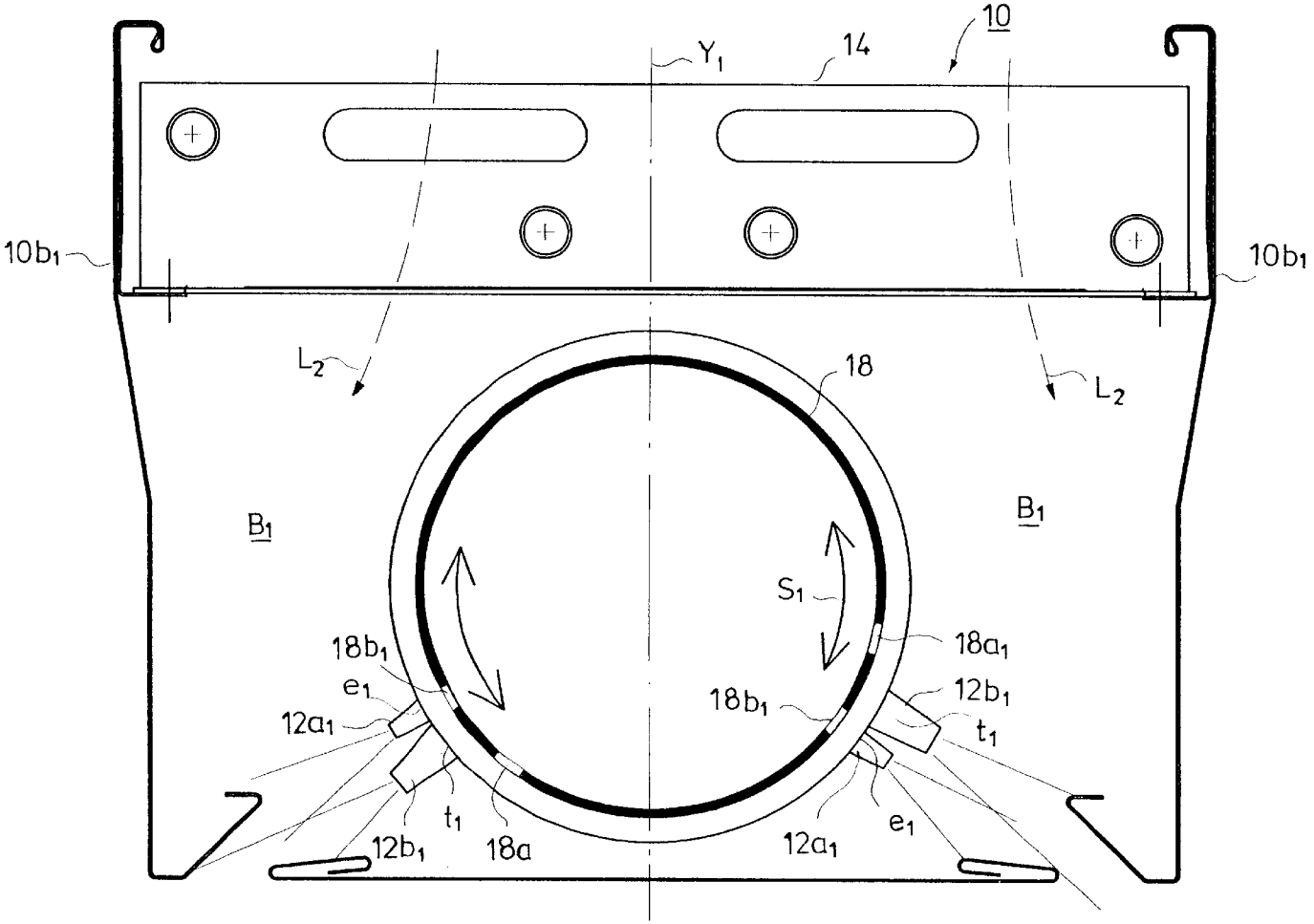
FIG. 3A shows an embodiment of the induction ratio control device, wherein the device includes two nozzle rows $\mathbf{12}a_1$, $\mathbf{12}a_2$ . . . and $\mathbf{12}b_1$, $\mathbf{12}b_2$ . . . for the primary air flow $L_1$, whereby the flow ratio between the nozzles of the nozzle rows is controlled with the aid of an aperture tube located in the supply chamber for the primary air flow, which tube includes flow apertures $\mathbf{18}b_1$, $\mathbf{18}b_2$ . . . for the nozzles of one nozzle row $\mathbf{12}a_1$, $\mathbf{12}a_2$ . . . and flow apertures $\mathbf{18}a_1$, $\mathbf{18}a_2$ . . . for the nozzles of the other nozzle row $\mathbf{12}b_1$, $\mathbf{12}b_2$ . . . .

FIG. 3A shows an embodiment of the invention, wherein the induction ratio control device 15 is formed in supply air chamber by a turning tube 18 located inside it and including flow apertures 18$a_1$, 18$a_2$ . . . , 18$b_1$, 18$b_2$ . . . in two rows roughly on opposite sides of tube 18. Supply air chamber 11, which is a structure having a circular cross section, includes nozzles 12$a_1$, 12$a_2$ . . . , 12$b_1$, 12$b_2$ . . . in two rows, into which flow apertures $e_1$, $e_2$ . . . , $t_1$, $t_2$, . . . open. By turning tube 18 (as shown by arrow $S_1$) including internal apertures 18$a_1$, 18$a_2$ . . . , 18$b_1$, 18$b_2$ . . . the apertures 18$a_1$, 18$a_2$ . . . , 18$b_1$, 18$b_2$ . . . in tube 18 are moved to the desired covering position in relation to supply apertures $e_1$, $e_2$ . . . , $t_1$, $t_2$ . . . of the nozzles 12$a_1$, 12$a_2$ . . . ; 12$b_1$, 12$b_2$ . . . Nozzles 12$b_1$, 12$b_2$ . . . have larger nozzle apertures $t_1$, $t_2$ . . . than the nozzles 12$a_1$, 12$a_2$ . . . located beside them, which have nozzle apertures $e_1$, $e_2$, . . . with a smaller cross-sectional flow area than the flow apertures $t_1$, $t_2$ . . . of nozzles 12$b_1$, 12$b_2$ . . . The following is arranged on the other side of central axis Y, at the location of the rows of nozzles 12$a_1$, 12$a_2$ . . . , 12$b_1$, 12$b_2$ . . . Nozzles 12$b_1$, 12$b_2$ . . . are located below nozzles 12$a_1$, 12$a_2$ . . . According to the invention, by rotating the internal tube 18 of the tubular supply air chamber 11 the flow can be guided as desired either into nozzles 12$b_1$, 12$b_2$ . . . or into nozzles 12$a_1$, 12$a_2$ . . . In this manner the flow rate of supply airflow $L_1$ in side chamber B, can be changed, and in this way the induction ratio between the flows $L_2$ and $L_1$ can be controlled, that is, the induction effect of flow $L_1$ on the flow of circulated air $L_2$ can be controlled. By increasing the flow into the nozzles of one nozzle row, for example, into nozzles 12$a_1$, 12$a_2$ . . . , by a corresponding volume the flow is reduced into the nozzles 12$b_1$, 12$b_2$ . . . of the other row, or the other way round. The total flow volume for flow $L_1$ through nozzle rows 12$a_1$, 12$a_2$ . . . ; 12$b_1$, 12$b_2$ . . . remains constant, but the flow rate changes, whereby the induction ratio is controlled.

Figure 3B:
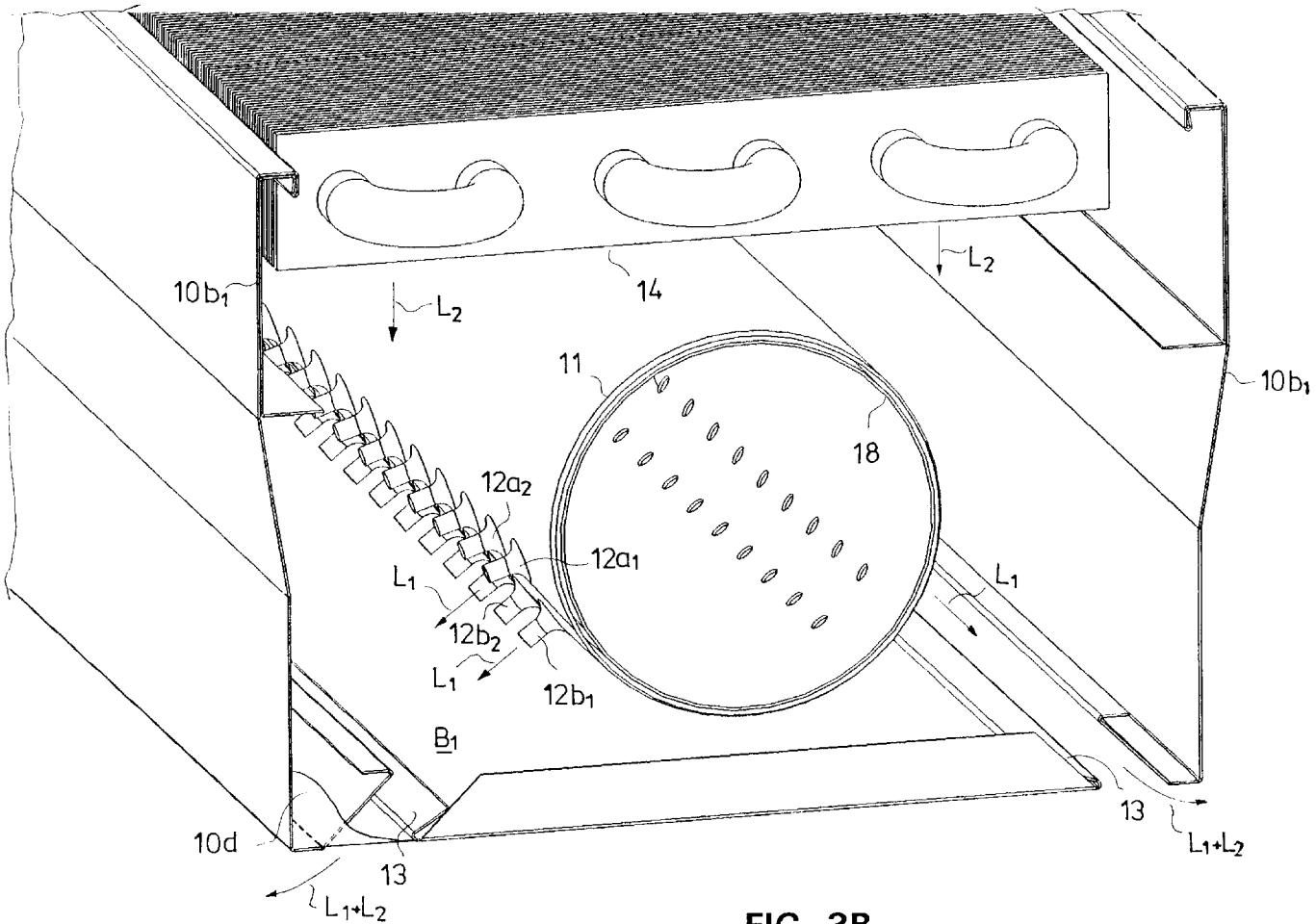
FIG. 3B is an axonometric partial view of the solution shown in FIG. 3A.

FIG. 3B is an axonometric partial view of the solution shown in FIG. 3A.

Figure 4B:
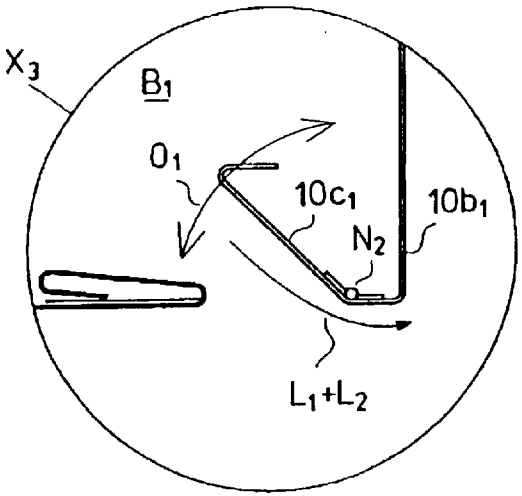
FIG. 4B shows the area $X_3$ of FIG. 4A on an enlarged scale.
Figure 4A:
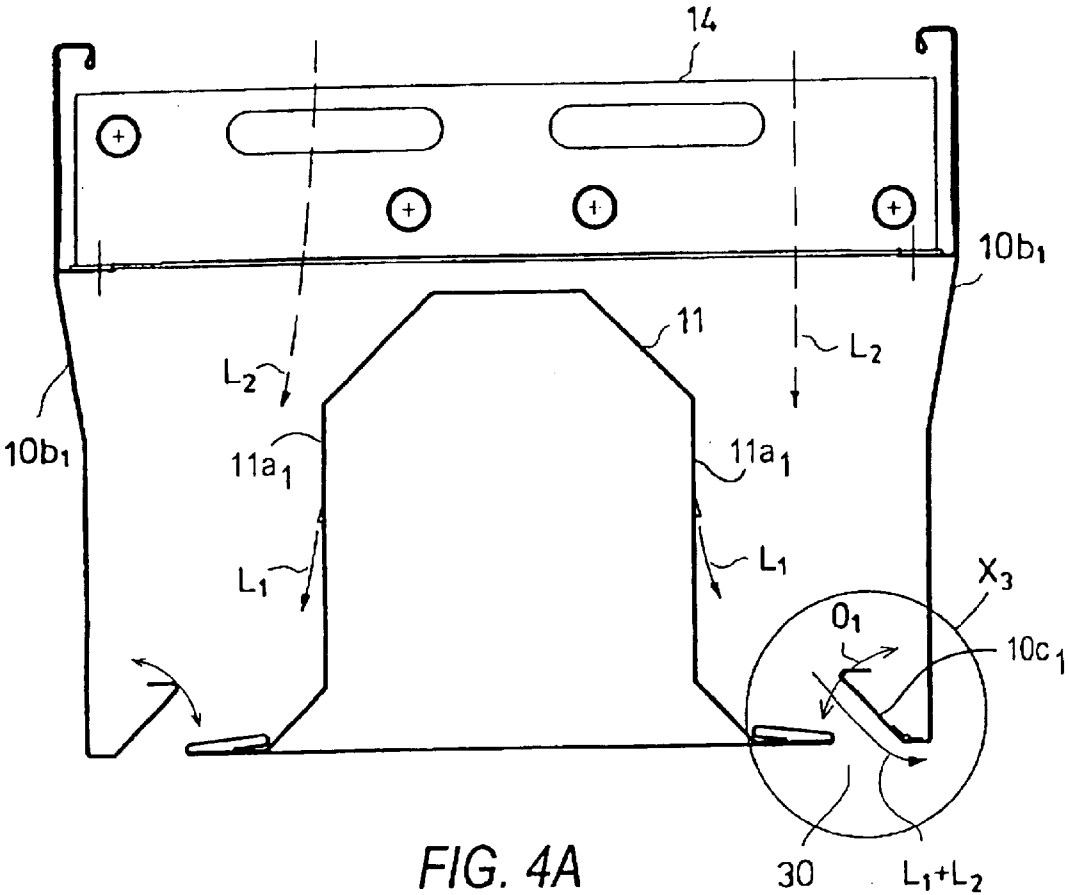
FIG. 4A shows a fifth embodiment of the control device solution according to the invention.

FIG. 4A shows a fourth advantageous embodiment of the invention, wherein the induction ratio between flows $L_1$ and $L_2$ is controlled by controlling a plate 10$c$, located in exhaust opening 30 and joined to side plate 10$b$. As shown by arrow $O_1$ in the figure, the plate 10$c_1$ can be turned around pivot point $N_2$ to the desired angle, whereby the induction ratio between flows $L_1$ and $L_2$ is also controlled.

FIG. 4B shows the area $X_3$ of FIG. 4A on an enlarged scale. As shown in the figure, the plate 10$c_1$ can be turned around pivot point $N_2$ as shown by arrow $O_1$.

We claim:

1. A supply air terminal device, comprising:

a body having a top portion, bottom portion, a first side plate and a second side plate, said body defining a first side chamber and a second side chamber and said bottom portion defining a first exhaust opening and a second exhaust opening, each of said first and second exhaust opening is respectively in flow communication with said first side chamber and said second side chamber;

a heat exchanger arranged in said top portion of said body, said heat exchanger is structured and arranged for receiving and treating a circulated air flow and passing said air flow into said first and second side chambers;

a supply enclosure positioned within said body, said supply enclosure having a plurality of apertures and defining a supply chamber for receiving a supply air flow, said supply chamber is structured and arranged to guide said supply air flow from said supply chamber through said plurality of apertures to said first and said second side chambers;

at least one control assembly positioned in at least one of said first and second side chambers, said control assembly comprising a control plate that is pivotably mounted and selectively rotatable so that a selected portion of said plate extends at least partially across a corresponding one of said first and second side chambers; and means for selectively rotating said control plate;

whereby a ratio of said supply air flow to said circulated air flow in an airflow exiting through said corresponding one of said first and second exhaust openings is controlled.

2. The supply air terminal device according to claim 1, wherein the means for selectively rotating said control plate is a pivotably mounted eccentric disk.

3. A supply air terminal device, comprising:

a body having a top portion, bottom portion, a first side plate and a second side plate, said body defining a first side chamber and a second side chamber and said bottom portion defining a first exhaust opening and a second exhaust opening, each of said first and second exhaust opening is respectively in flow communication with said first side chamber and said second side chamber;

a heat exchanger arranged in said top portion of said body, said heat exchanger is structured and arranged for receiving and treating a circulated air flow and passing said air flow into said first and second side chambers;

a supply enclosure positioned within said body, said supply enclosure having a plurality of apertures and defining a supply chamber for receiving a supply air flow, said supply chamber is structured and arranged to guide said supply air flow from said supply chamber through said plurality of apertures to said first and said second side chambers;

at least one control assembly positioned in at least one of said first and second side chambers, said control assembly comprising a control plate that is pivotably mounted and selectively rotatable so that a selected portion of said plate extends at least partially across a corresponding one of said first and second exhaust opening; and means for selectively rotating said control plate;

whereby a ratio of said supply air flow to said circulated air flow in an airflow exiting through said corresponding one of said first and second exhaust openings is controlled.

4. The supply air terminal device according to claim 3, wherein the control plate is connected to corresponding one of said first side plate and said second side plate.

* * * * *